US009070334B2

(12) United States Patent
Chen et al.

(10) Patent No.: US 9,070,334 B2
(45) Date of Patent: Jun. 30, 2015

(54) DISPLAY DEVICE

(75) Inventors: Yu-Cheng Chen, Hsin-Chu (TW); Tsan-Chun Wang, Hsin-Chu (TW); Wan-Yu Lo, Hsin-Chu (TW)

(73) Assignee: AU Optronics Corp., Science-Based Industrial Park, Hsin-Chu (TW)

( * ) Notice: Subject to any disclaimer, the term of this patent is extended or adjusted under 35 U.S.C. 154(b) by 765 days.

(21) Appl. No.: 12/760,539

(22) Filed: Apr. 14, 2010

(65) Prior Publication Data

US 2011/0122052 A1 May 26, 2011

(30) Foreign Application Priority Data

Nov. 23, 2009 (TW) ..... 98139755 A

(51) Int. Cl.
*G09G 3/32* (2006.01)
*G09G 3/36* (2006.01)

(52) U.S. Cl.
CPC ..... *G09G 3/3648* (2013.01); *G09G 3/3607* (2013.01); *G09G 2300/0426* (2013.01)

(58) Field of Classification Search
CPC ..... G09G 2300/043; G09G 2300/0421; G09G 2300/0426; G09G 3/3648; G09G 3/3607
USPC ..... 345/55
See application file for complete search history.

(56) References Cited

U.S. PATENT DOCUMENTS

| | | | | |
|---|---|---|---|---|
| 7,463,230 | B2 * | 12/2008 | Lee | 345/87 |
| 7,511,691 | B2 * | 3/2009 | Hirayama et al. | 345/88 |
| 7,567,330 | B2 | 7/2009 | Yamada et al. | |
| 8,284,340 | B2 * | 10/2012 | Park et al. | 349/54 |
| 2004/0212770 | A1 * | 10/2004 | Lee | 349/141 |
| 2005/0266595 | A1 * | 12/2005 | Lee | 438/30 |
| 2006/0232739 | A1 | 10/2006 | Yeo et al. | |
| 2007/0146611 | A1 * | 6/2007 | Kang | 349/149 |
| 2008/0111933 | A1 | 5/2008 | Lee et al. | |
| 2009/0065767 | A1 | 3/2009 | Reynolds et al. | |
| 2009/0164963 | A1 * | 6/2009 | Zarkesh-Ha et al. | 716/12 |
| 2009/0173521 | A1 * | 7/2009 | Yokai et al. | 174/251 |
| 2009/0173530 | A1 * | 7/2009 | Sakamoto et al. | 174/261 |
| 2010/0002180 | A1 * | 1/2010 | Kim et al. | 349/143 |
| 2010/0033664 | A1 * | 2/2010 | Lee | 349/139 |
| 2010/0079717 | A1 * | 4/2010 | Park et al. | 349/152 |
| 2010/0171687 | A1 * | 7/2010 | Chiang et al. | 345/98 |
| 2010/0315317 | A1 * | 12/2010 | Li et al. | 345/55 |
| 2012/0001885 | A1 * | 1/2012 | Kang et al. | 345/211 |

FOREIGN PATENT DOCUMENTS

| | | |
|---|---|---|
| CN | 1743926 A | 3/2006 |
| TW | 200622364 | 7/2006 |

* cited by examiner

*Primary Examiner* — Andrew Sasinowski
*Assistant Examiner* — Mihir Rayan
(74) *Attorney, Agent, or Firm* — Winston Hsu; Scott Margo

(57) ABSTRACT

A display device includes a plurality of gate lines, data lines, first external gate tracking lines, and second external gate tracking lines. The first external gate tracking lines are substantially disposed in a border region of a substrate, and electrically connected with corresponding gate lines. The second external gate tracking lines are substantially disposed in the border region of the substrate, and electrically connected with corresponding gate lines. One of the first external gate tracking lines and a corresponding second external gate tracking line at least partially overlap with each other.

8 Claims, 7 Drawing Sheets

DISPLAY DEVICE

BACKGROUND OF THE INVENTION

1. Field of the Invention

The present invention relates to a display device, and more particularly to a display device having a narrow border and a uniform loading effect by disposing the external gate tracking lines in the border region, where the external gate tracking lines include first external gate tracking lines and second external gate tracking lines at least partially overlapping with each other.

2. Description of the Prior Art

As the prevailing of multimedia application, display devices with a high resolution and a larger visible range become the development trend of the technology. While the resolution of the display device is improved, the number of conducting wires in the border region of the display device also increases. Therefore, in the border region of the conventional display device, more space is required for accommodating numerous conducting wires. Accordingly, the area of the border region of the display device can not be further decreased. In addition, because the RC loading of the conducting wires in the border region and that of the conducting wires in the display region are different, it may adversely influence the display quality of the conventional display device.

SUMMARY OF THE INVENTION

It is therefore one of the objectives of the present invention to provide a display device having a narrow border and a uniform loading effect.

According to a preferred embodiment of the present invention, a display device is provided. The display device includes a substrate, a plurality of gate lines, a plurality of data lines, a plurality of first external gate tracking lines, and a plurality of the second external gate tracking lines. The substrate has a display region and a border region. The gate lines are substantially disposed in the display region of the substrate along a first direction. The data lines are substantially disposed in the display region of the substrate along a second direction. The first external gate tracking lines are substantially disposed in the border region of the substrate, wherein each of the first external gate tracking lines is electrically connected with a corresponding gate line. The second external gate tracking lines are substantially disposed in the border region of the substrate, wherein each of the second external gate tracking lines is electrically connected with a corresponding gate line. In addition, each of the first external gate tracking lines and a corresponding second external gate tracking line at least partially overlap with each other.

According to another preferred embodiment of the present invention, a display device is provided. The display device includes a substrate, a plurality of gate lines, a plurality of data lines, a plurality of first external gate tracking lines, a plurality of the second external gate tracking lines, and a plurality of compensation electrodes. The substrate has a display region and a border region. The gate lines are substantially disposed in the display region of the substrate along a first direction. The data lines are substantially disposed in the display region of the substrate along a second direction. The first external gate tracking lines are substantially disposed in the border region of the substrate, wherein each of the first external gate tracking lines is electrically connected with a corresponding gate line. The second external gate tracking lines are substantially disposed in the border region of the substrate, wherein each of the second external gate tracking lines is electrically connected with a corresponding gate line. Each of the compensation electrodes is substantially disposed between a first external gate tracking line and a second external gate tracking line, wherein the first external gate tracking lines are formed by a first conductive layer, the compensation electrodes are formed by a second conductive layer, and the second external gate tracking lines are formed by a third conductive layer.

In the border region of the display device of the present invention, the first external gate tracking line and the second external gate tracking line are disposed to overlap with each other. Accordingly, the size of the border region can be reduced. In addition, the display device can have a uniform loading effect by the loading compensation capacitors which are formed by the first external gate tracking lines and the second external gate tracking lines.

These and other objectives of the present invention will no doubt become obvious to those of ordinary skill in the art after reading the following detailed description of the preferred embodiment that is illustrated in the various figures and drawings.

DETAILED DESCRIPTION

To provide a better understanding of the presented invention, preferred embodiments will be made in details. The preferred embodiments of the present invention are illustrated in the accompanying drawings with numbered elements. In addition, the preferred embodiments exemplarily utilize a liquid crystal display panel to illustrate the display device of the present invention, but the application of the present invention is not limited to herein.

Figure 1:
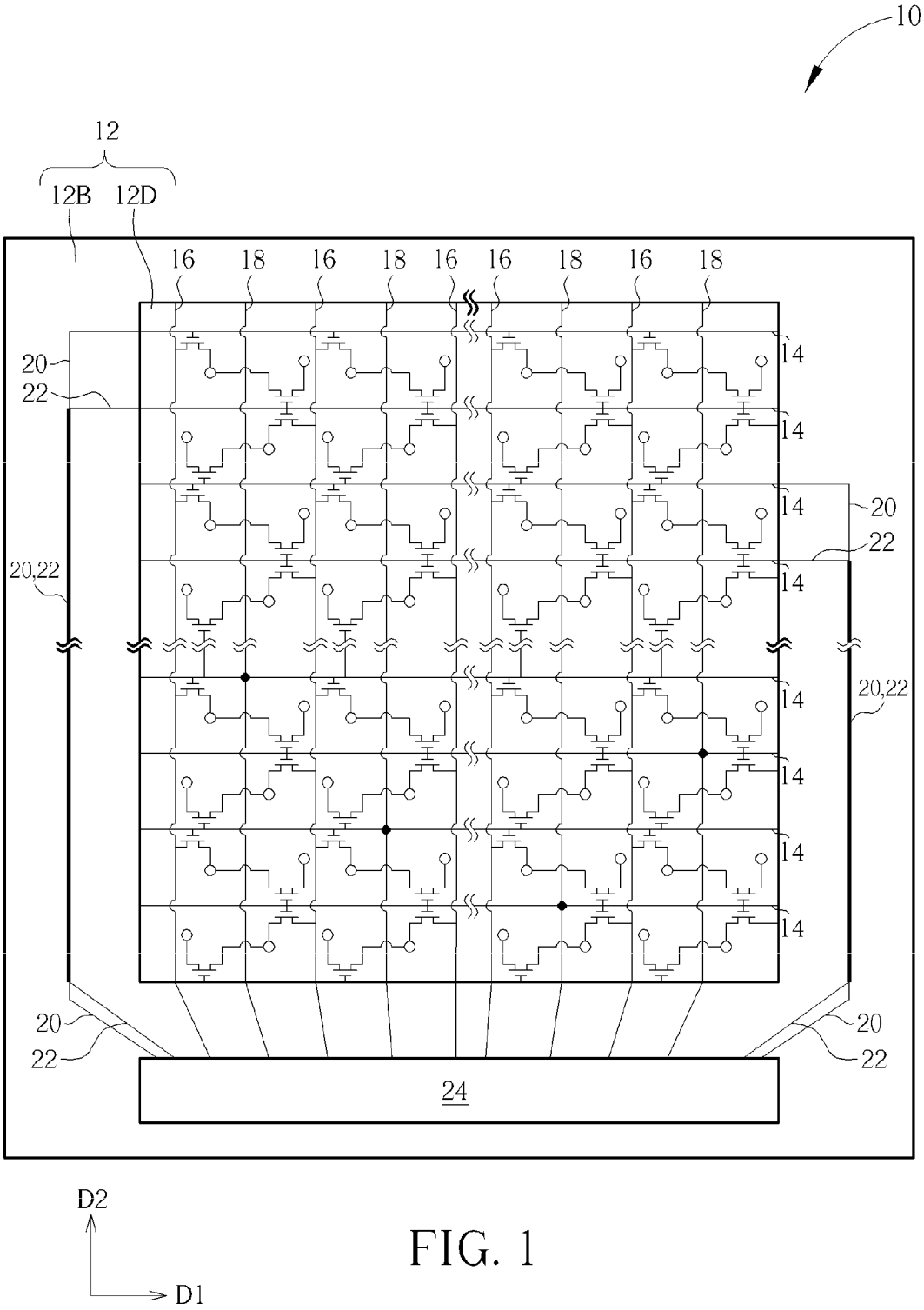
FIG. 1 is a schematic diagram illustrating a display device according to a preferred embodiment of the present invention.
Figure 2:
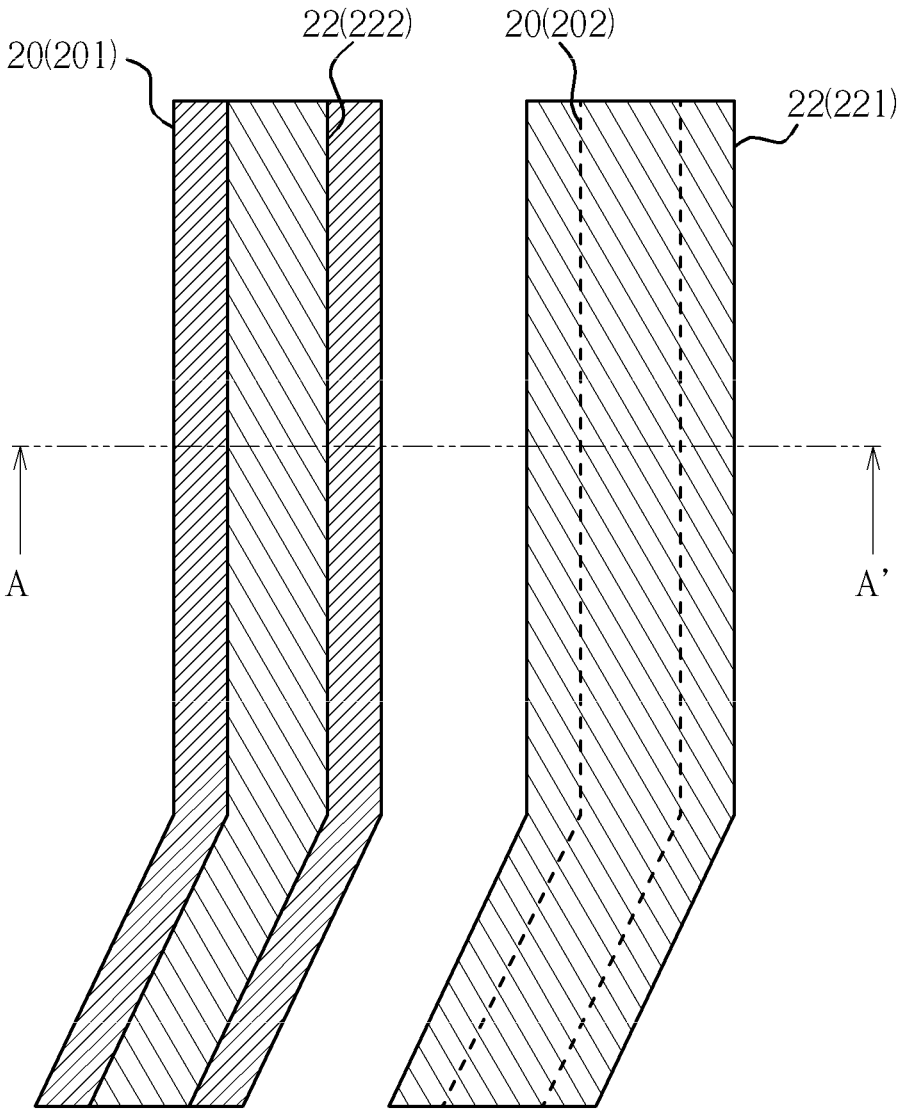
FIG. 2 is a schematic top view illustrating the first external gate tracking lines and the second external gate tracking lines of the display device of FIG. 1.
Figure 3:
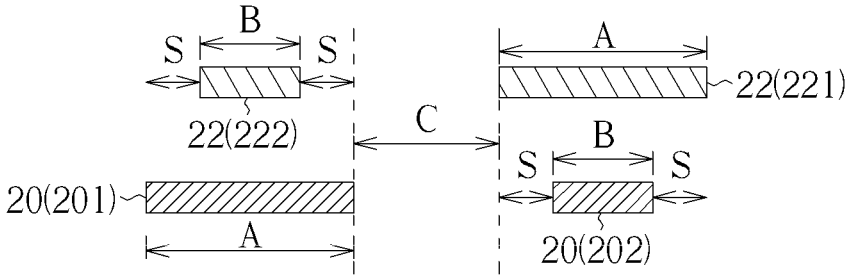
FIG. 3 is a schematic cross-sectional view illustrating the first external gate tracking lines and the second external gate tracking lines of the display device along a line A-A' of FIG. 2.

Refer to FIGS. 1-3. FIG. 1 is a schematic diagram illustrating a display device according to a preferred embodiment of the present invention. FIG. 2 is a schematic top view illustrating the first external gate tracking lines and the second external gate tracking lines of the display device of FIG. 1, and FIG. 3 is a schematic cross-sectional view illustrating the first external gate tracking lines and the second external gate tracking lines of the display device along a line A-A' of FIG. 2. As shown in FIG. 1, the display device 10 of the present embodiment includes a substrate 12, a plurality of gate lines 14, a plurality of data lines 16, a plurality of the internal gate tracking lines 18, a plurality of first external gate tracking lines 20, a plurality of the second external gate tracking lines 22, and at least a driver chip 24. The substrate 12 has a display region 12D and a border region 12B. The gate lines 14 are substantially disposed in the display region 12D of the substrate 12 along a first direction D1 (such as a horizontal direction in FIG. 1), and the gate lines 14 are substantially parallel to each other. The data lines 16 are substantially disposed in the display region 12D of the substrate 12 along a second direction D2 (such as a perpendicular direction in FIG. 1), and the data lines 16 are electrically connected with the driver chip 24. Also, the data lines 16 are substantially parallel to each other. The internal gate tracking lines 18 are substantially disposed in the display region 12D of the substrate 12 along the second direction, and the internal gate tracking lines 18 are substantially parallel to each other. Each of the internal gate tracking lines 18 is electrically connected with a corresponding gate line 14, so that a part of the gate lines 14 can be electrically connected with the driver chip 24 through the internal gate tracking lines 18. The first external gate tracking lines 20 are substantially disposed in the border region 12B of the substrate 12, and each of the first external gate tracking lines 20 is electrically connected with a corresponding gate line 14, so that a part of the gate lines 14 can be electrically connected with the driver chip 24 through the first external gate tracking lines 20. The second external gate tracking lines 22 are substantially disposed in the border region 12B of the substrate 12, and each of the second external gate tracking lines 22 is electrically connected with a corresponding gate line 14, so that a part of the gate lines 14 can be electrically connected with the driver chip 24 through the second external gate tracking lines 22. In addition, the display device 10 also includes a sealant (not shown in the figure) disposed in the border region 12B of the substrate 12, and the substrate 12 can be bonded to another substrate (not shown in the figure) by the sealant. In the present embodiment, a part of the gate lines 14 are electrically connected with the driver chip 24 through the internal gate tracking lines 18, wherein the internal gate tracking lines 18 are disposed in the display region 12D, and the internal gate tracking lines 18 and the data lines 16 are located alternately and parallel to each other. Also, another part of gate lines 14 are electrically connected with the driver chip 24 through the first external gate tracking lines 20 and the second external gate tracking lines 22 which are disposed in the border region 12B. It is to be noted that in the above and following embodiments of the present invention, the first direction D1 represents the horizontal direction in a top-view, and the second direction D2 represents the perpendicular direction in a top-view.

The first external gate tracking lines 20 and the second external gate tracking lines 22 of the present embodiment are configured to overlap with each other. In order to highlight the electrically connections between the first external gate tracking lines 20 and the second external gate tracking lines 22 of the display device 10, the relative location of the first external gate tracking lines 20 and the second external gate tracking lines 22 is not shown in FIG. 1, but shown in FIG. 2 and FIG. 3. As shown in FIG. 2 and FIG. 3, the first external gate tracking lines 20 and the second external gate tracking lines 22 are formed by different conductive layers. For example, the first external gate tracking lines 20 are formed by a first conductive layer, and the second external gate tracking lines 22 are formed by a second conductive layer, but not limited. In this embodiment, the first conductive layer and the second conductive layer are located sequentially in a vertical direction. It is noted that in the above and following embodiments of the present invention, the vertical direction represents the vertical direction in a cross-sectional view. The material of each conductive layer, for instance, can be metal, conductive metallic oxide, or semiconductor materials. In the present embodiment, the first external gate tracking lines 20 are defined into a first group 201 with a first line width A and a second group 202 with a second line width B. Specifically, each of the first external gate tracking lines 20 of the first group 201 has a first line width A, and each of the first external gate tracking lines 20 of the second group 202 has a second line width B. That is, a first line width of a part of the first external gate tracking lines 20 is A, and a second line width of a part of the first external gate tracking lines 20 is B. Also, the first external gate tracking lines 20 with the first line width A and the first external gate tracking lines 20 with the first line width B are located alternately. In addition, the second external gate tracking lines 22 are defined into a first group 221 with a first line width A and a second group 222 with a second line width B. Specifically, each of the second external gate tracking lines 22 of the first group 221 has the first line width A, and each of the second external gate tracking lines 22 of the second group 222 has the second line width B. Also, the second external gate tracking lines 22 with the first line width A and the second external gate tracking lines 22 with the second line width B are located alternately. Furthermore, each of the first external gate tracking lines 20 and a corresponding second external gate tracking line 22 at least partially overlap with each other. For the sake of clear illustration, at least a film layer between the first external gate tracking lines 20 and the second external gate tracking lines 22 of the present embodiment is not shown in the figure, such as a dielectric material serving as a capacitance dielectric layer (not shown in the figure), but it is not limited to herein. As a result, each of the first external gate tracking lines 20, the corresponding second external gate tracking lines 22, and the capacitance dielectric layer disposed therebetween can form a loading compensation capacitor, so that the display device 10 can have a uniform RC loading effect.

In the present embodiment, the first external gate tracking lines 20 with the first line width A and the corresponding second external gate tracking lines 22 with the second line width B at least partially overlap. In addition, the first external gate tracking lines 20 with the first line width A and the corresponding second external gate tracking lines 22 with the second line width B, for instance, substantially have a common centerline, i.e. the distance from any one of both sides of the first external gate tracking line 20 with the first line width A to an adjacent side of the corresponding second external gate tracking line 22 with the second line width B is S. Accordingly, the tolerance to an alignment deviation in the manufacturing process can be improved, and the change of the capacitance value of the loading compensation capacitor resulted from the alignment deviation can be avoided. Furthermore, the first external gate tracking line 20 with the first line width A and the second external gate tracking line 22 with the first line width A have a spacing C therebetween in a horizontal direction, wherein the spacing C is a horizontal spacing measured along the horizontal direction in a cross-sectional view. In arranging the first external gate tracking lines 20 and the second external gate tracking lines 22, the first line width A, the second line width B, and the spacing C are preferable to satisfy the relation of $A>B$ and $C/(A+C)>1/4$. For example, the first line width A is 5 micrometers, the second line width B is 3 micrometers, and the spacing C is 3 micrometers, but not limited. As the first line width A, the second line width B, and the spacing C satisfy the aforementioned relation, the sealant of the display device 10 can be effectively hardened with sufficient luminance in the light curing process. For example, under the condition where the first line width A is 5 micrometers, the second line width B is 3 micrometers, and the spacing C is 3 micrometers, the total width of the single external gate tracking line unit (including the first external gate tracking line 20 and the second external gate tracking line 22 overlapping with each other) is 8 micrometers, which is the sum of the first width A (5 micrometers) and the spacing C (3 micrometers). The light transmissive region is disposed in the location corresponding to the spacing C, and the transmittance of the border region 12B is 37.5% (3/8). Under this transmittance, the sealant can have enough luminance in the light curing process.

Figure 4:
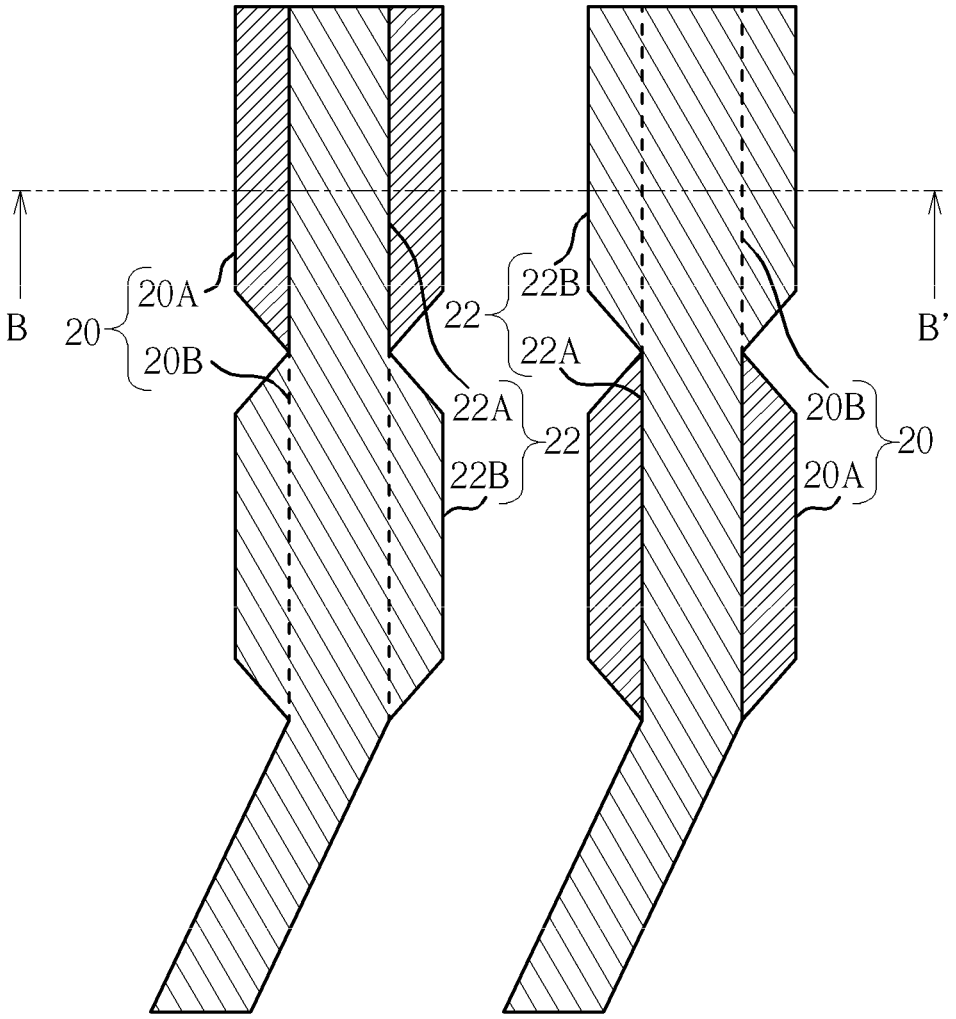
FIG. 4 is a schematic top view illustrating the first external gate tracking lines and the second external gate tracking lines of the display device according to another preferred embodiment of the present invention.
Figure 5:
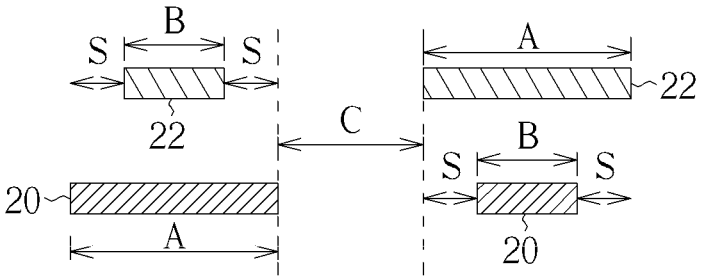
FIG. 5 is a schematic cross-sectional view illustrating the first external gate tracking lines and the second external gate tracking lines of the display device along a line B-B' of FIG. 4.

To simplify the description and for the convenience of comparison between each of the embodiments of the present invention, identical elements are denoted by identical numerals. Also, only the differences are illustrated, and repeated descriptions are not redundantly given. Refer to FIG. 4 and FIG. 5, and in combination with FIG. 1. FIG. 4 is a schematic top view illustrating the first external gate tracking lines and the second external gate tracking lines of the display device according to another preferred embodiment of the present invention, and FIG. 5 is a schematic cross-sectional view illustrating the first external gate tracking lines and the second external gate tracking lines of the display device along a line B-B' of FIG. 4. In the aforementioned embodiment, the single first external gate tracking lines 20 only has a single line width (such as the first line width A or the second line width B), and the single second external gate tracking lines 22 also only has a single line width (such as the first line width A or the second line width B). In the present embodiment, the single first external gate tracking lines 20 and/or the single second external gate tracking lines 22 can have a plurality of line width. In other words, the line width of the single first external gate tracking lines 20 and/or the single second external gate tracking lines 22 is not fixed and may be modified. As shown in FIG. 4 and FIG. 5, the single first external gate tracking lines 20 has a first region 20A and a second region 20B, wherein the first region 20A has the first line width A, the second region 20B has the second line width B, and the first line width A is not equal to the second line width B. In addition, each of the second external gate tracking lines 22 has a first region 22A and a second region 22B, wherein the first region 22A has the second line width B, the second region 22B has the first line width A, the first line width A is not equal to the second line width B. In the present embodiment, the first region 20A of each first external gate tracking line 20 and the first region 22A of the corresponding second external gate tracking line 22 at least partially overlap with each other, and the second region 20B of each first external gate tracking line 20 and the second region 22B of the corresponding second external gate tracking line 22 at least partially overlap with each other. However, in the present embodiment, the first line width A of the first region 20A of the first external gate tracking line 20, for instance, can be designed to be equal or not equal to the first line width A of the second region 22B of the second external gate tracking line 22. The second line width B of the second region 20B of the first external gate tracking line 20, for instance, can be designed to be equal or not equal to the second line width B of the first region 22A of the second external gate tracking line 22. But it is not limited to herein.

Figure 6:
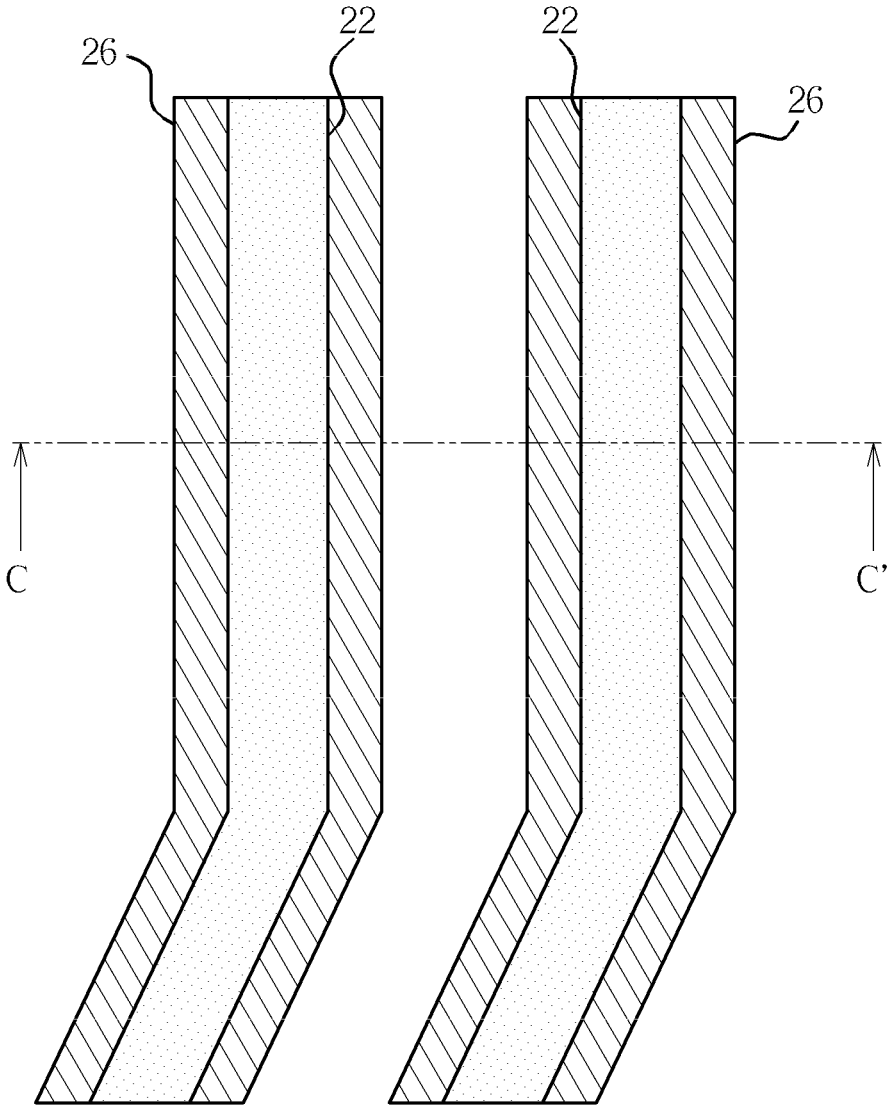
FIG. 6 is a schematic top view illustrating the first external gate tracking lines and the second external gate tracking lines of the display device according to further another preferred embodiment of the present invention.
Figure 7:
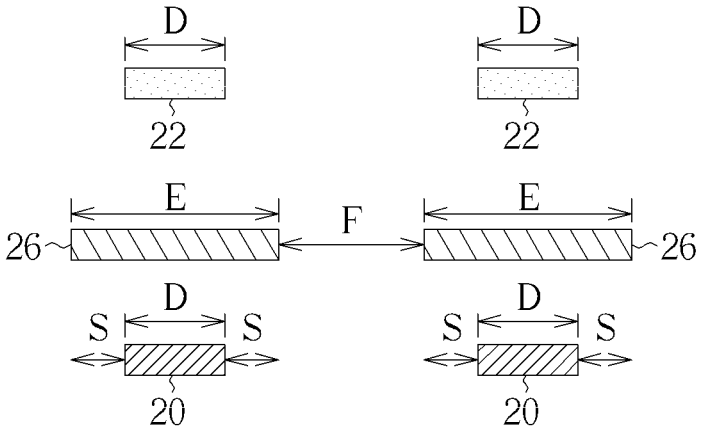
FIG. 7 is a schematic cross-sectional view illustrating the first external gate tracking lines and the second external gate tracking lines of the display device along a line C-C' of FIG. 6.

Refer to FIG. 6 and FIG. 7, and in combination with FIG. 1. FIG. 6 is a schematic top view illustrating the first external gate tracking lines and the second external gate tracking lines of the display device according to further another preferred embodiment of the present invention, and FIG. 7 is a schematic cross-sectional view illustrating the first external gate tracking lines and the second external gate tracking lines of the display device along a line C-C' of FIG. 6. As shown in FIG. 6 and FIG. 7, In the present embodiment, the first external gate tracking lines 20 are formed by the first conductive layer, and the second external gate tracking lines 22 are formed by a third conductive layer. The material of each conductive layer, for instance, can be metal, conductive metallic oxide, or semiconductor materials. In addition, there are compensation electrodes 26 which are formed by the second conductive layer and are disposed between each first external gate tracking line 20 and the corresponding second external gate tracking line 22. It is noted that in the present invention, the first conductive layer, the second conductive layer and the third conductive layer are located sequentially in a vertical direction in a cross-sectional view. For the sake of clear illustration, at least a film layer between the first external gate tracking lines 20 and the second external gate tracking lines 22 of the present embodiment is not shown in the figure, such as a dielectric material serving as a capacitance dielectric layer (not shown in the figure), but it is not limited to herein. The compensation electrode 26, for instance, is electrically connected with the common signal line (not shown in the figure) of the display device. For example, the compensation electrode 26 and the common signal line can be formed by the same conductive layer, and the compensation electrode 26 can be electrically connected with the common signal line directly. Or, the compensation electrode 26 and the common signal line can be formed by different conductive layers, but the compensation electrode 26 can be electrically connected with the common signal line in other way. As a result, the compensation electrode 26 is applied with a common voltage signal, but it is not limited to herein. Each first external gate tracking line 20, the corresponding second external gate tracking line 22, and the compensation electrode 26 disposed between the first external gate tracking line 20 and the second external gate tracking line 22 overlap with each other, so that a loading compensation capacitor can be formed and therefore the display device can have a uniform RC loading effect. In the present embodiment, the first external gate tracking lines 20 has a third line width D, the second external gate tracking lines 22 also has the third line width D, but not limited. That is, the third line width D of the first external gate tracking line 20 and the third line width D of the second external gate tracking line 22 can be equal or unequal. The compensation electrode 26 has a fourth line width E, and the spacing between two adjacent compensation electrodes 26 is F. In addition, the first external gate tracking line 20, the corresponding second external gate tracking line 22, and the corresponding compensation electrodes 26 have a common centerline, i.e. the distance from any one of both sides of the first external gate tracking line 20 or the second external gate tracking lines 22 to an adjacent side of the corresponding compensation electrodes 26 is S, wherein S is a horizontal distance. Accordingly, the tolerance to an alignment deviation in the manufacturing process can be improved, and the change of the capacitance value of the loading compensation capacitor resulted from the alignment deviation can be avoided. In arranging the first external gate tracking lines 20, the second external gate tracking lines 22, and the compensation electrodes 26, a relation of $E>D$ and $F/(E+F)>1/4$ is preferable for the third line width D, the fourth line width E, and the spacing F. For example, the third line width D is 3 micrometers, the fourth line width E is 5 micrometers, and the spacing F is 4 micrometers, but it is not limited to herein. As the third line width D, the fourth line width E, and the spacing F satisfy the aforementioned relation, the sealant of the display device 10 can be effectively hardened with sufficient luminance in the light curing process. For example, as the fourth line width E is 5 micrometers and the spacing F is 4 micrometers, the total width of the single external gate tracking line unit is 9 micrometers, which is the sum of the fourth width E (5 micrometers) and the spacing F (4 micrometers). As a result, the transmittance of the border region 12B is 44.4% (4/9), and the sealant can have enough luminance in the light curing process.

In summary, in the border region of the display device of the present invention, the first external gate tracking line and the second external gate tracking line are disposed to overlap with each other. Accordingly, the size of the border region can be reduced. In addition, the display device can have a uniform loading effect and a better display quality by the loading compensation capacitors which are formed by the first external gate tracking lines and the second external gate tracking lines. Also, in the first external gate tracking lines and the second external gate tracking lines according to the present invention, the ratio of the line width to the spacing can be definite to provide enough luminance on the sealant in the border region, so that the sealant can be effectively hardened in the light curing process.

Those skilled in the art will readily observe that numerous modifications and alterations of the device and method may be made while retaining the teachings of the invention.

What is claimed is:

1. A display device, comprising:

a substrate, having a display region and a border region;

a plurality of gate lines, substantially disposed in the display region of the substrate along a first direction;

a plurality of data lines, substantially disposed in the display region of the substrate along a second direction;

a plurality of first external gate tracking lines, substantially disposed in the border region of the substrate, wherein each of the first external gate tracking lines is electrically connected with a corresponding gate line, the first external gate tracking lines are formed by a first conductive layer, a first group of the first external gate tracking lines has a first line width, a second group of the first external gate tracking lines has a second line width less than the first line width, and the first external gate tracking lines with the first line width and the first external gate tracking lines with the second line width are located alternately;

a plurality of second external gate tracking lines, substantially disposed in the border region of the substrate, wherein each of the second external gate tracking lines is electrically connected with a corresponding gate line, a first group of the second external gate tracking lines has the first line width, a second group of the second external gate tracking lines has the second line width, and the second external gate tracking lines with the first line width and the second external gate tracking lines with the second line width are located alternately;

a driver chip;

wherein one of the first external gate tracking lines and a corresponding second external gate tracking line at least partially overlap with each other, and each of the first/second external gate tracking lines is electrically connected between the corresponding gate line and the driver chip.

2. The display device of claim 1, wherein one of the first external gate tracking lines with the first line width and one of the second external gate tracking lines with the second line width at least partially overlap with each other, and one of the first external gate tracking lines with the second line width and one of the second external gate tracking lines with the first line width at least partially overlap with each other.

3. The display device of claim 2, wherein the first external gate tracking line with the first line width and the corresponding second external gate tracking line with the second line width have a common centerline.

4. The display device of claim 2, wherein the first external gate tracking line with the first line width and the second external gate tracking line with the first line width have a spacing therebetween in a horizontal direction.

5. The display device of claim 1, wherein each of the first external gate tracking lines is electrically connected with only one corresponding gate line, and each of the second external gate tracking lines is electrically connected with only one corresponding gate line.

6. A display device, comprising:

a substrate, having a display region and a border region;

a plurality of gate lines, substantially disposed in the display region of the substrate along a first direction;

a plurality of data lines, substantially disposed in the display region of the substrate along a second direction;

a plurality of first external gate tracking lines, substantially disposed in the border region of the substrate, wherein each of the first external gate tracking lines is electrically connected with a corresponding gate line, and each of the first external gate tracking lines has a first line width;

a plurality of the second external gate tracking lines, substantially disposed in the border region of the substrate, wherein each of the second external gate tracking lines is electrically connected with a corresponding gate line, and each of the second external gate tracking lines has the first line width;

a plurality of internal gate tracking lines, substantially disposed in the display region of the substrate along the second direction;

a driver chip, wherein each of the internal gate tracking lines is electrically connected with one of the gate lines for electrically connecting the gate line with the driver chip disposed on the substrate; and a plurality of compensation electrodes, wherein each of the compensation electrodes is substantially corresponding to one of the first external gate tracking lines and corresponding to one of the second external gate tracking lines at the same time, each of the compensation electrodes substantially disposed between and overlapping its corresponding first external gate tracking line and its corresponding second external gate tracking line along a direction perpendicular to a surface of the substrate in the border region, the compensation electrodes are applied with a common voltage signal, and each of the compensation electrodes has a second line width different from the first line width;

wherein one of the first external gate tracking lines and a corresponding second external gate tracking line at least partially overlap with each other, and each of the first/second external gate tracking lines is electrically connected between the corresponding gate line and the driver chip.

7. A display device, comprising:

a substrate, having a display region and a border region;

a plurality of gate lines, substantially disposed in the display region of the substrate along a first direction;

a plurality of data lines, substantially disposed in the display region of the substrate along a second direction;

a plurality of first external gate tracking lines, substantially disposed in the border region of the substrate, wherein each of the first external gate tracking lines is electrically connected with a corresponding gate line, the first external gate tracking lines are formed by a first conductive layer;

a plurality of second external gate tracking lines, substantially disposed in the border region of the substrate, wherein each of the second external gate tracking lines is electrically connected with a corresponding gate line; and a driver chip;

wherein one of the first external gate tracking lines and a corresponding second external gate tracking line at least partially overlap with each other, each of the first/second external gate tracking lines is electrically connected between the corresponding gate line and the driver chip, each of the first external gate tracking lines has a first region having a first width and a second region having a second width less than the first width, each of the second external gate tracking lines has a first region having the second width and a second region having the first width, the first region of one of the first external gate tracking lines corresponds to and partially overlaps the first region of the corresponding second external gate tracking line, and the second region of the first external gate tracking line corresponds to and partially overlaps the second region of the corresponding second external gate tracking line.

8. A display device, comprising:

a substrate, having a display region and a border region;

a plurality of gate lines, substantially disposed in the display region of the substrate along a first direction;

a plurality of data lines, substantially disposed in the display region of the substrate along a second direction;

a plurality of first external gate tracking lines, substantially disposed in the border region of the substrate, wherein each of the first external gate tracking lines is electrically connected with a corresponding gate line, the first external gate tracking lines are formed by a first conductive layer, each of the first external gate tracking lines has a first region having a first width and a second region having a second width less than the first width; and a plurality of second external gate tracking lines, substantially disposed in the border region of the substrate, wherein each of the second external gate tracking lines is electrically connected with a corresponding gate line, each of the second external gate tracking lines has a first region having the second width and a second region having the first width;

wherein the first region of one of the first external gate tracking lines corresponds to and partially overlaps the first region of the corresponding second external gate tracking line, and the second region of the first external gate tracking line corresponds to and partially overlap the second region of the corresponding second external gate tracking line.

* * * * *